United States Patent [19]

Houot

[11] Patent Number: 4,982,794

[45] Date of Patent: Jan. 8, 1991

[54] APPARATUS FOR OIL/GAS SEPARATION AT AN UNDERWATER WELL-HEAD

[75] Inventor: Jean-Jacques Houot, Sartrouville, France

[73] Assignee: Societe Nationale Elf Aquitaine (Production), Courbevoie, France

[21] Appl. No.: 329,596

[22] Filed: Mar. 28, 1989

[51] Int. Cl.[5] ..... E21B 43/36

[52] U.S. Cl. ..... 166/357; 166/267; 210/170

[58] Field of Search ..... 166/357, 267, 265; 210/170, 188; 405/211, 195, 222, 226

[56] References Cited

U.S. PATENT DOCUMENTS

| | | | |
|---|---|---|---|
| 3,875,998 | 4/1975 | Charpentier | 166/357 |
| 3,893,918 | 7/1975 | Favret, Jr. | 210/170 |
| 4,506,735 | 3/1985 | Chaudot | 166/357 |
| 4,527,632 | 7/1985 | Chaudot | 166/357 |
| 4,558,744 | 12/1985 | Gibb | 405/226 |
| 4,685,833 | 8/1987 | Iwamoto | 166/357 |
| 4,793,418 | 12/1988 | Wheeler et al. | 166/357 |

FOREIGN PATENT DOCUMENTS

| | | |
|---|---|---|
| 1591780 | 6/1970 | France . |
| 2026277 | 9/1970 | France . |
| 2146931 | 3/1973 | France . |
| 81/01310 | 5/1981 | PCT Int'l Appl. . |
| 83/01471 | 4/1983 | PCT Int'l Appl. . |
| 1309826 | 3/1973 | United Kingdom . |
| 1420011 | 1/1976 | United Kingdom . |
| 2063776 | 6/1981 | United Kingdom . |
| 2063777 | 6/1981 | United Kingdom . |
| 2066095 | 7/1981 | United Kingdom . |

*Primary Examiner*—Bruce M. Kisliuk

*Attorney, Agent, or Firm*—Oblon, Spivak, McClelland, Maier & Neustadt

[57] ABSTRACT

The installation combines with at least one production well-head an oil/gas separator of substantial vertical elongation and of which the major part may be housed in a pit sunk and lined closed to the working well, which permits of wide fluctuations in the oil/gas level between the high and low control points while ensuring sufficient submersion of the pump with which the separator is equipped. This apparatus makes it possible separately to draw off the gas on the one hand and the sufficiently degasified oil on the other, from a peripheral site to a central production station.

5 Claims, 3 Drawing Sheets

APPARATUS FOR OIL/GAS SEPARATION AT AN UNDERWATER WELL-HEAD

BACKGROUND OF THE INVENTION

The present invention relates to an underwater installation for the production of hydrocarbons on a site the size of which does not allow the building of hydrocarbon treatment and extraction installations and for which it is therefore necessary to arrange for the crude effluent to be drawn off through an underwater pipeline to a central installation which carries out such functions.

Even if they spread over quite a wide area, it is normal practice with underwater hydrocarbon deposits to drain off the major part of the reserves in situ by a central plant which generally consists of one or more platforms or an anchored lighter. The peripheral parts of these deposits, particularly the periclinal areas, are then regarded as being marginal operations; the same applies to small deposits which are often situated close to an operable field.

For these marginal or peripheral parts, as for the small adjacent fields, routing of effluent to a central installation is therefore required. However, if the distance is considerable, several kilometers, if the percentage of gas associated with the oil (in English "Gas Oil Ratio" or GOR) is high, and if it is known that it can fluctuate during the course of production, two major difficulties will become manifest:

the loss of head under diphasic conditions throughout the ducting as a whole may become excessive having regard to the eruptive pressure, if production under continuous conditions remains possible when this latter is established, restarting of the well or wells after a shut-down may become impossible by reason of the segregation of the liquid phase which results in the formation of a column of degasified liquid which is of excessive hydrostatic weight.

Precautions may be taken against these difficulties by increasing the pressure available at the inlet to the discharge ducting by various means.

An electric pump may be provided at the bottom of the well, taking into account the actual technical limitations inherent in bottom pumps, particularly the limited free gas content at intake, and the risk of frequent maintenance operations (in English "WORK OVER").

It is also possible to set up a gas lift inside the well, a measure which has already been adopted for submerged well operations but which, at a considerable distance from a platform, tends to cause an increase in the head losses in the receiving pipeline and requires a considerable amount of gas to be in circulation by reason of the high average pressure required.

It is also possible to install a diphasic delivery pump near the well-head. This formula has the disadvantage of the low output of diphasic pumps when the GOR increases, which has to be countered by large dimensions and power levels.

As increasing the pressure available at the well-head comes up against serious difficulties as soon as the GOR becomes significant, it has been suggested to avoid these problems by separating the delivery of the gaseous phase from that of the liquid phase by setting up close to the well-head an off-shore production separator. But, such equipment has not been found to be very adaptable to underwater use. In fact, land-based separators are equipment of which the dimensions have been optimised. They require maintaining the level of the oil/gas interface within a narrow range of around 10 of so centimeters and maintaining a high level of separation efficiency calls for frequent adjustments. Finally, with such separators, the height of oil is only around a meter, which hardly facilitates oil pick-up by a conventional type of bottom pump (well bottom pumps, for example).

Thus, many models of off-shore-converted land-based separators have been suggested but have not found practical acceptance, for example:

U.S. Pat. No. 3,875,998 (Charpentier) discloses a horizontal separator disposed in the bottom part of a column supported by an articulating arrangement where the difficulties of adjustment linked with the low height of the separator tank were aggravated by the reciprocating nature of the installation.

FR No. 2,026,277 (Ocean Systems) includes horizontal off-shore-converted separators set up directly on the sea bottom, as in the following patent.

FR No. 1,591,780 (Orieux) where the separator is toxic which would be an advantage for connection to the various inlet and outlet pipes, but it does leave the same drawbacks linked with the narrowness of the range of adjustment.

SUMMARY OF THE INVENTION

An object of the present invention is to alleviate these difficulties and to do so it proposes installing close to the operating well a separator of considerable vertical elongation, so that the height of the liquid can vary by several decimeters, or even several meters, between the high and low points of operation and so that, despite these fluctuations in level, adequate submersion is always applied to a pump intended to draw off the said liquid.

A separator of considerable vertical elongation may be placed on the sea bottom and, if it is isolated and is substantially larger than the rest of the equipment, it may constitute an problem during handling operations around the site and may even be a danger to navigation. It is possible then to connect it to a tower supporting a platform or even integrate it into the tower; it is also possible to place it in the bottom part of a reciprocating column supported by an articulating arrangement if such an arrangement is available, such as is described in U.S. Pat. No. 3,875,998 (Charpentier).

If the production well is isolated, such as an economically marginal well might be, a characteristic feature of the invention will then be to house the separator in a pit sunk into the sea bottom close to the operating well.

Preferably, the pit which is sunk and lined must be capable of accommodating a sufficiently large part of the separator that the part remaining above the sea bottom is of a height which does not exceed the height of the adjacent well-head, so that the major part of the separator is housed in the pit.

According to one embodiment, the separator consists of a cylindrical chamber closed at its bottom end and of which the top end is fixed to the lining of the pit sunk into the sea bottom close to the working well and it also comprises an assembly adapted to close the top end of the chamber and, through this closure, introduce into the chamber a nozzle for extracting the effluent from the operating well, a nozzle for drawing off the gas, a pipe connecting a pump situated in the bottom part of the chamber and provided with energy supply means and means for connection to a device for monitoring the level of oil/gas in the chamber, to an oil discharge pipe, the various means constituting this assembly being capable of being removed from the chamber and raised to the surface jointly or separately for maintenance purposes.

According to another embodiment, the separator consists of a cylindrical chamber closed at its top and bottom ends and removably fixed to the lining of a pit sunk into the sea bottom close to the working well, and an assembly capable of introducing into the top part of the chamber a nozzle for extracting the effluent from the working well, a nozzle for drawing off the gas, a pipe connecting a pump located in the bottom part of the chamber and provided with energy supply means and means of connection to a device for measuring the level of oil/gas in the chamber, to an oil discharge pipe, the cylindrical chamber and the said means which it contains constituting one assembly which can be raised to the surface as a complete unit.

If a diphasic pump is provided to draw off the oil from the separator, the control system can be simplified by replacing the means of monitoring the oil/gas level in the chamber by direct monitoring of the rate of flow of liquid arriving at the central installation.

BRIEF DESCRIPTION OF THE DRAWINGS

Further characteristic features and advantages of the invention will become evident from reading the ensuing description of a preferred embodiment of the invention which is given by way of indication and which implies no limitation, reference being made to the accompanying drawings, in which.

DETAILED DESCRIPTION OF THE PREFERRED EMBODIMENTS

Figure 1:
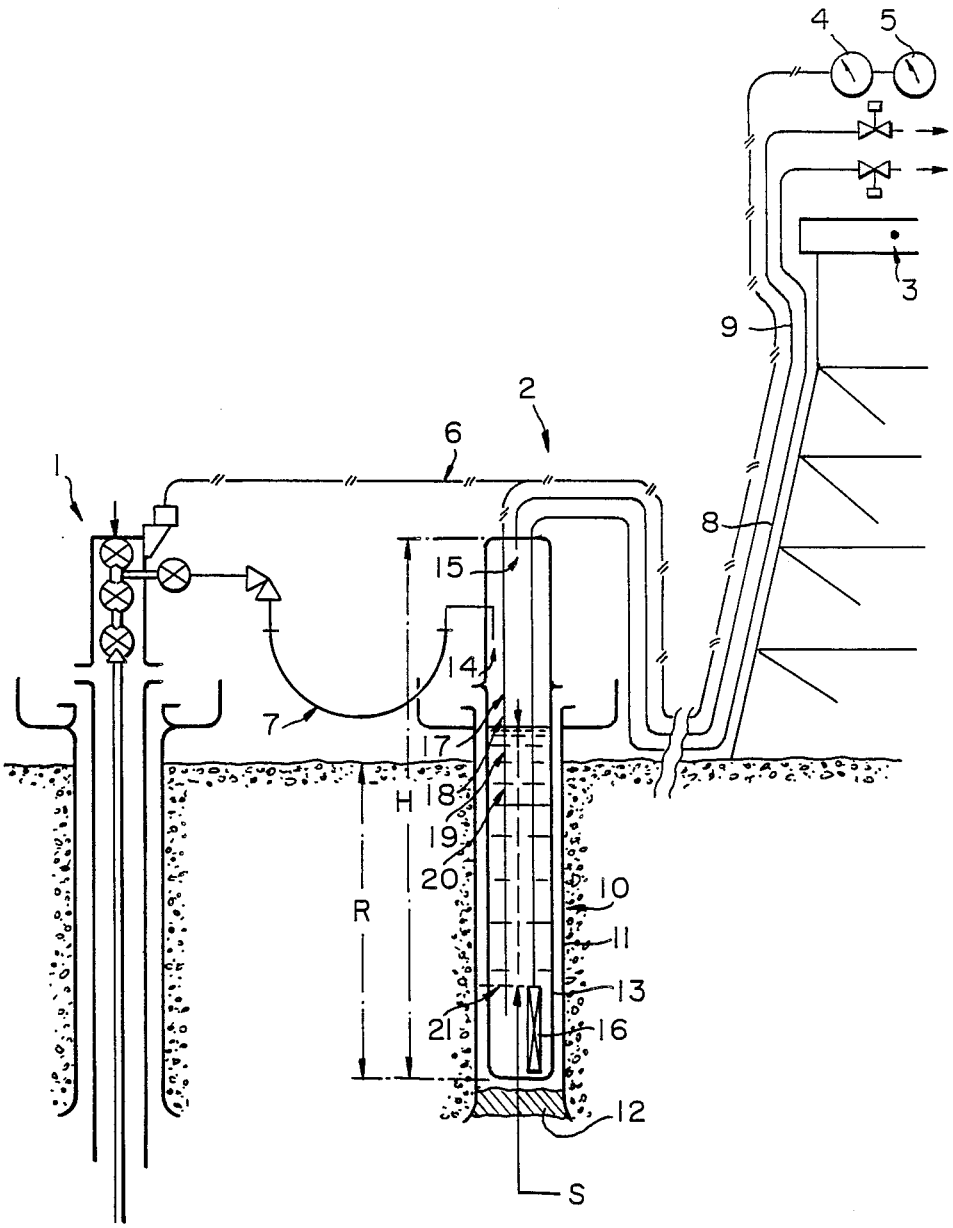
FIG. 1 is an overall diagram of the installation.

With reference to FIG. 1 showing in principle the diagram of an installation according to the invention, there is an underwater well-head (1) close to which there is installed a separator (2) and, at a distance therefrom which might be quite considerable, a platform (3) carrying the installations for processing and carrying away the hydrocarbons, the said installations not being shown, and also means of monitoring and controlling the well-head (4) and the separator (5).

Between the well-head (1), the separator (2) and the monitoring and control means (4) and (5), electric transmission cables are provided and are shown diagrammatically by the line (6).

The well-head (1) is connected to the separator (2) by a pipe (7) for carrying effluent from the well.

The separator (2) is connected to the processing installations on the platform (3) by two pipes, viz. a pipe (8) for the liquid phase and a pipe (9) for the gaseous phase.

The vertical type separator (2) is accommodated in a pit (10) sunk at a short distance, perhaps a few meters from the head of the working well (1).

The pit (10), after the lining (11) has been placed in position, together with a bottom plug (12) and the bore hole cementation, defines a vertical cylindrical space in which the separator (2) is installed.

The separator (2) broadly consists of a cylindrical chamber bounded by a vertical body (13) closed at its top and bottom ends. This chamber is provided at the top with two nozzles, one (14) for the arrival of effluent from the well-head (1) and the other (15) for discharging the gaseous phase through the pipe (9) to the platform (3). Furthermore, the separator (2) is fitted with a vertical pipe provided at the bottom with a pump (16) fitted with a bottom motor and connected at the top to the pipe (8) for discharging the liquid phase and a means of monitoring the position of the liquid/gas interface in the separator, the monitoring device consisting of electrodes such as (17), (18), (19), (20) distributed along a vertical red (21) and connected by electrical conductors to the monitoring mechanism (5).

The height (H) of the separator (2) is such that the bottom pump (16) is submerged by a sufficient amount (S) for its efficiency to be optimum, i.e. so that it pumps liquid regardless of the level of the oil/gas interface. As the height of the separator (2) above the sea bottom must not exceed that of the well-head (1), it follows that the height (R) below the bottom is determined and that the depth of the pit to be sunk to house the separator can thus be calculated.

Figure 2:
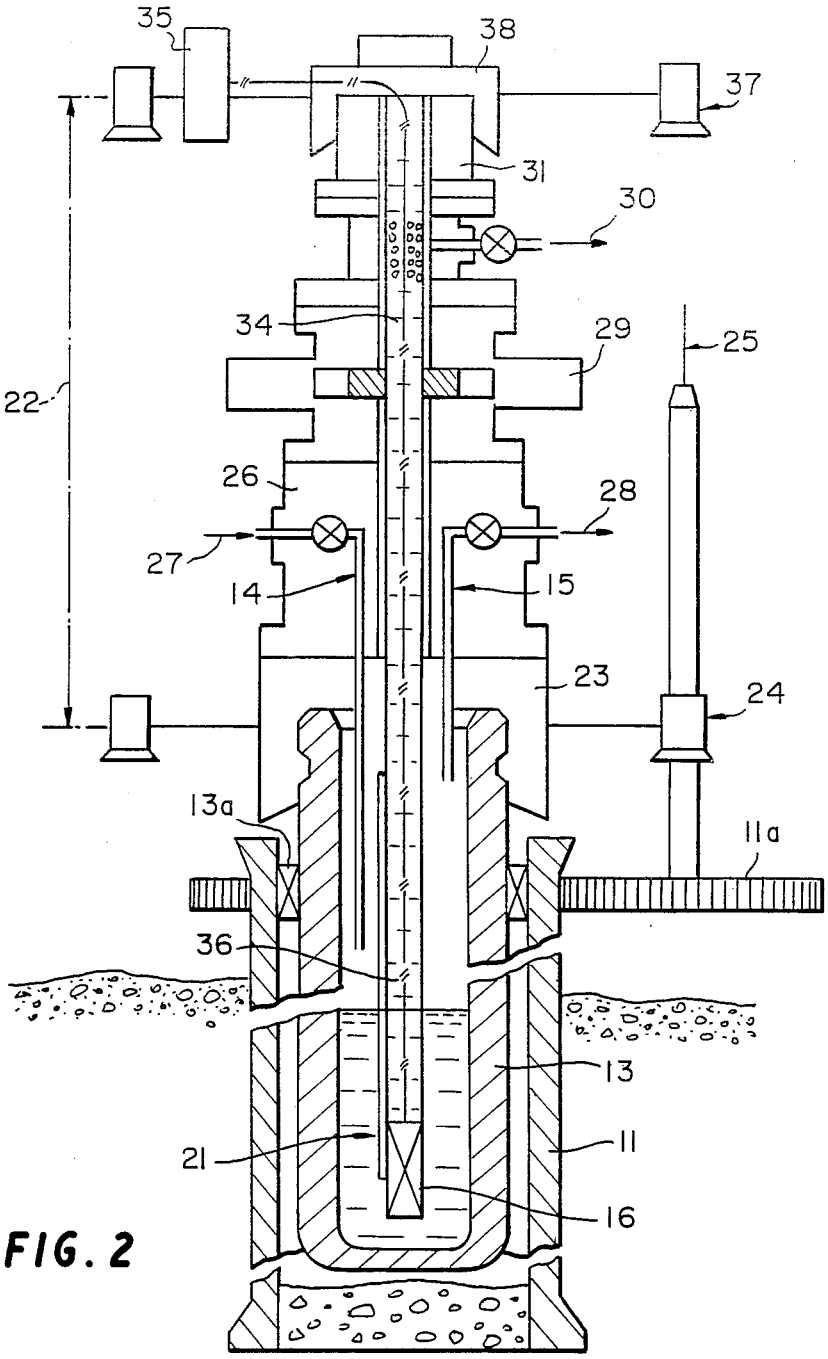
FIG. 2 shows a separator which can be dismantled at the bottom.

FIG. 2 shows an embodiment of a separator in which the vertical body (13) bounding the chamber in which the separation is carried out is installed in a lining (11) of a pit sunk for the purpose, this lining carrying a baseplate (11*a*) so that the various mechanical elements which permit of fluid intake, discharge of the two (liquid and gaseous) constituents, monitoring and safety facilities, are placed on the tube (13) to which they are fixed by superimposition of the constituents in a manner comparable to a well-head.

The installation comprises three parts:

1. A separating chamber consisting of a body (13) closed at its bottom end and disposed within a lining (11) of a diameter which is as large as necessary (for example up to 80 or 100 cm) cemented into the ground. The lining is installed in a pit sunk to a depth of several tens of meters, 50 m generally being sufficient. The body (13) is united with the lining (11) by means of an annular position and orientating device (13*a*).
2. A module (22) similar to a well-head and comprising, from the bottom upwards:
   - a hydraulic crude oil connector (23) of a diameter which is appropriate in the light of the diameter of the body (13), for anchoring the module (22) on the body (13), and also a guide assembly (24) on guidelines (25);
   - a forged block (26) comprising two remotely controlled hydraulic valves (27 and 28) on the intake (14) for diphasic fluid (27) and the outlet (15) of the separated gas (28);
   - a device (29) which, in operation, ensures annular fluid-tightness around the oil delivery pipe. This equipment is provided with hydraulic control means, not shown;
   - a bracing arrangement with a remotely controlled hydraulic valve for discharging oil (30);
   - a chuck (31) for anchoring of a hydraulic connector.
3. A module, pumping tube (33) and a cover plate (33) embodying all the sensitive components of the separator, viz.:
   - a submerged pump (16),
   - a cable (34) for supplying power to the pump (16);
   - separator regulating equipment, which may comprise a level detector such as shown diagrammatically at (21) in FIG. 1 or a pressure detector, or both at the same time;

a remote monitoring system (35);
a delivery pipe (36) from the submerged pump (16);
a guide assembly (37) on guidelines;
a protective cover (38) with a connector (13) ⅝" which is at the top of the module.

The liquid or gaseous effluent inlets and outlets (27, 28, 30) will be provided with manual or automatic connecting means, not shown, to fit the well-head and the discharge pipelines.

This separating assembly has an appearance similar to that of a submerged production well-head. Handling operations can be carried out by using conventional and prior art means such as the handling equipment, cables, linkages . . .

Like the work of raising the equipment for inspection and maintenance, positioning can be carried out in a single unit by means of guidelines (25) or in two parts by successively using guidelines (25) and the guide assembly (37).

Figure 3:
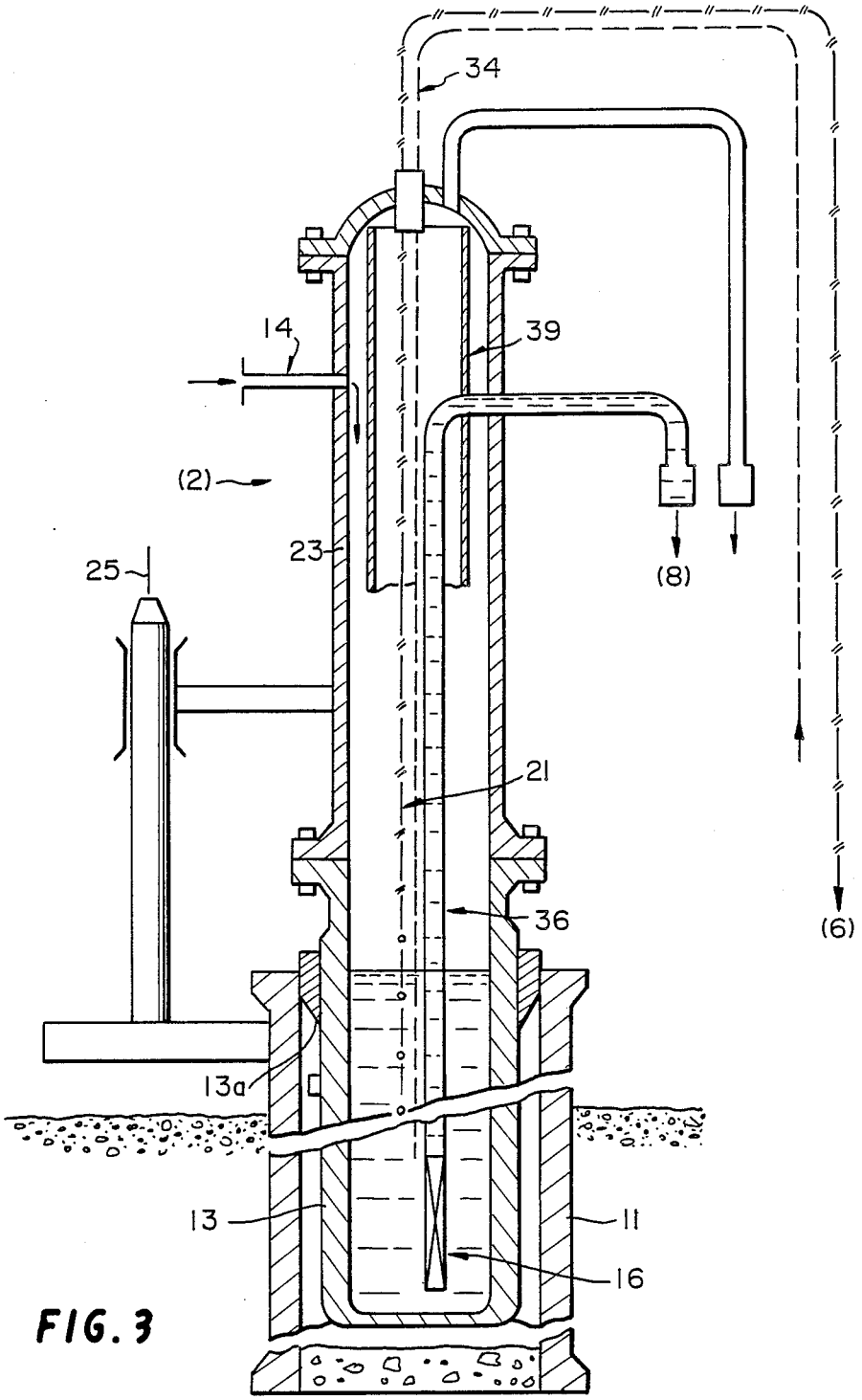
FIG. 3 shows a separator which is not intended to be dismantled at the bottom.

FIG. 3 shows a separating assembly designed to be set in place in a single unit in a pit which has been sunk, lined and cemented for the purpose. This assembly can be lifted in a single unit after disconnection of the various fluid inlet and outlet nozzles and disconnection of the power supply cable and communication cables which provide the link with the monitoring means.

The body of the separator (2) consists of a cylindrical chamber bounded by a vertical tubular body (13) closed at its top and bottom ends.

The body of the separator (2) consists of a plurality of elements which are so designed as to cope with the stresses of factory installation of the internal equipment. The assembly of these elements by prior art means is shown diagrammatically in the drawing as an assembly using flanges and bolts.

The internal equipment may be those items shown diagrammatically in FIG. 1 and described with reference to FIG. 2, viz.:

a submerged pump (16) at the bottom end of the delivery pipe (36) which is extended outside the separator (2) via a pipe (8), not shown;
a cable (36) carrying power to the pump (16);
regulating equipment (21) for the separator, connected to a remote monitoring system (35) not shown by means of cables (6);
an inlet (14) for effluent from the well (1);
an outlet (15) for the gaseous phase;
a guide assembly (24) on guidelines (25) for positioning and withdrawing the separating assembly (2).

Disposed between the tube (13) and the lining (11) are various items (13*a*) for positioning and orientating the separating device (2) inside the lining (11).

The installation at the bottom may be inspected by divers and it may also be completely remotely controlled from the surface using means known in the art and conventionally used.

The separator is linked to the well-head and to the discharge pipelines by manual or automatic connection means, not shown.

In the various embodiments, the height of liquid in the bottom part of the chamber provides the desired advantage of the most continuous possible operation of the pump. It also allows the gas bubbles to rise through the liquid column so that the liquid which is conveyed to the pump inlet is as far as possible free from free gas in the form of bubbles.

The thermodynamic and mechanical conditions under which this is carried out are not necessarily those which permit of optimum separation of the two liquid and gaseous phases. It follows that the separated gas will probably contain condensate. A more intensive separation could possibly be carried out at the central production station on the sea bottom or at the surface.

Without departing from the scope of the invention, it may be envisaged to improve the separation on the actual site of the working well by disposing in the top part of the separator various elements of impact plates or liners designed to separate flow or for purposes of centrifugation (39 in FIG. 3) such as the devices which are known in the art.

It is possible to envisage these elements being set in position not only in order to improve the overall separation but also in order more easily to absorb pressure surges due to the frequently observed random passage of gas-locks.

I claim:

1. An underwater installation for the production of hydrocarbons, comprising:
at least one working wellhead;
an oil/gas separator comprising a vertically elongated body;
a lined pit sunk in the sea bottom close to the well, wherein said separator is partially housed in said pit by a degree such that the height of the separator does not exceed that of the wellhead, whereby said separator is removable from said pit; and
a pump for discharging liquid in said body adjacent the bottom thereof, wherein the length of said body is sufficient that said pump may be positioned in said body such that said pump is always immersed in oil despite normal fluctuations in the height of the oil.

2. An installation according to claim 1 in which the body comprises:
a cylindrical chamber closed at its bottom end and of which the top end is fixed to the lining of said pit, an assembly comprising:
(a) means to close the top end of the chamber and to introduce into said chamber a nozzle for effluent from the working well,
(b) a nozzle for drawing off gas,
(c) a pipe connected to said pump,
(d) energy supply means and means for connection to a device for monitoring the oil/gas level in the chamber, and
(e) an oil draw-off nozzle; and
means for separating and raising the elements of the assembly.

3. An installation according to claim 1, in which the body comprises:
a cylindrical chamber closed at its top and bottom ends, removably fixed to the lining of said pit, an assembly comprising:
(a) means to introduced into the top part of the chamber a nozzle for the effluent from the working well,
(b) a nozzle for drawing off gas,
(c) a pipe connecting said pump with energy supply means and means for connection to a device for monitoring the oil/gas level in the chamber,
(d) an oil draw-off nozzle, and
means for forming the cylindrical chamber and said assembly into a unit which can be raised to the surface.

4. An installation according to claim 1 in which the oil/gas separator is installed in the bottom part of a structure supported by an articulating arrangement.

5. An installation according to claim 1, in which the pump is a diphasic pump.

* * * * *